US010618087B2

(12) United States Patent
Ylä-Outinen et al.

(10) Patent No.: US 10,618,087 B2
(45) Date of Patent: Apr. 14, 2020

(54) METHOD AND SYSTEM FOR RECOVERING ANTIFREEZE FROM A DUST PREVENTION SYSTEM OF A MINERAL MATERIAL PROCESSING PLANT

(71) Applicant: Metso Minerals, Inc., Helsinki (FI)

(72) Inventors: Kai Ylä-Outinen, Pirkkala (FI); Harri Niemi, Tampere (FI); Timo Mustonen, Tampere (FI); Niko Ranta, Ikkeläjärvi (FI); Juhamatti Heikkilä, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 329 days.

(21) Appl. No.: 15/114,108

(22) PCT Filed: Jan. 21, 2015

(86) PCT No.: PCT/FI2015/050033

§ 371 (c)(1),
(2) Date: Jul. 26, 2016

(87) PCT Pub. No.: WO2015/114206

PCT Pub. Date: Aug. 6, 2015

(65) Prior Publication Data

US 2017/0008049 A1 Jan. 12, 2017

(30) Foreign Application Priority Data

Jan. 29, 2014 (FI) ..... 20145096

(51) Int. Cl.
*B08B 17/00* (2006.01)
*B08B 17/02* (2006.01)
(Continued)

(52) U.S. Cl.
CPC ..... *B08B 17/025* (2013.01); *B08B 9/035* (2013.01); *B08B 9/0325* (2013.01); *B08B 17/00* (2013.01)

(58) Field of Classification Search
CPC ..... B08B 9/0325; B08B 17/025; B08B 9/035; B08B 17/00
See application file for complete search history.

(56) References Cited

U.S. PATENT DOCUMENTS 4,286,617 A 9/1981 Bedient
4,531,538 A 7/1985 Sandt et al.
(Continued)

FOREIGN PATENT DOCUMENTS

CN 201720151 1/2011
CN 202731982 2/2013
(Continued)

OTHER PUBLICATIONS

International Search Report for PCT/FI2015/050033 dated Apr. 2, 2015.
(Continued)

*Primary Examiner* — Alexander Markoff
(74) *Attorney, Agent, or Firm* — Andrus Intellectual Property Law, LLP

(57) ABSTRACT

A system for recovering antifreeze from a dust prevention system of a mineral material processing plant, wherein the system includes an antifreeze tank, a pump configured to circulate water and/or antifreeze, a first valve configured to connect to a water inlet and/or antifreeze tank to the pump, a nozzle manifold connected to the pump, a second valve configured to connect the nozzle manifold to the antifreeze tank and/or a third valve, and a control system. The control system is configured to operate the system according to a method including the steps of sucking water using a pump from a water inlet via a first valve, displacing the antifreeze via a nozzle manifold into an antifreeze tank until the water reaches a second valve, and connecting the second valve to a third valve to allow circulation of water in the system.

8 Claims, 10 Drawing Sheets

(51) Int. Cl.
*B08B 9/035* (2006.01)
*B08B 9/032* (2006.01)

(56) References Cited

U.S. PATENT DOCUMENTS

| | | | | |
|---|---|---|---|---|
| 5,636,763 | A | 6/1997 | Furness | |
| 5,785,857 | A * | 7/1998 | Kelly | B01J 39/04 210/195.2 |
| 5,922,198 | A * | 7/1999 | Kelly | B01J 39/04 210/241 |
| 7,934,664 | B1 * | 5/2011 | Wolter | B60H 1/00364 123/142.5 R |
| 7,954,506 | B2 * | 6/2011 | Swan | E03B 7/12 137/334 |
| 2006/0021915 | A1 | 2/2006 | Bjornson et al. | |

FOREIGN PATENT DOCUMENTS

| | | |
|---|---|---|
| DE | 102012002032 | 10/2012 |
| JP | 2003251131 | 9/2003 |

OTHER PUBLICATIONS

Written Opinion for PCT/FI2015/050033 dated Apr. 2, 2015.
Search Report for Finnish Priority Application No. 20145096 dated Sep. 15, 2014.

* cited by examiner

METHOD AND SYSTEM FOR RECOVERING ANTIFREEZE FROM A DUST PREVENTION SYSTEM OF A MINERAL MATERIAL PROCESSING PLANT

CROSS-REFERENCE TO RELATED APPLICATIONS

This application claims priority to PCT/FI2015/050033, filed Jan. 21, 2015, and published in English on Aug. 6, 2015 as publication number WO 2015/114206, which claims priority to FI Application No. 20145096, filed Jan. 29, 2014, incorporated herein by reference.

FIELD OF INVENTION

The invention relates to a method and system for dust prevention in a mineral material processing plant and to a mineral material processing plant. In particular, but not exclusively, the invention relates to a method and system for recovering antifreeze from a dust prevention system of a mineral material processing plant.

BACKGROUND OF THE INVENTION

Mineral material, such as stone, is retrieved to be crushed from the ground either by exploding or by digging. The mineral material may also comprise natural stone, gravel and construction waste. Both mobile crushers and fixed crusher applications are used for crushing. The material to be crushed is fed with an excavator or a wheel loader into a feed hopper of the crusher, from where the material to be crushed falls into the jaws of the crusher, or a feeder or a feeder device transfers the stone material towards the crusher.

A mineral material processing plant comprises on or more crushers and/or screens and possibly further devices such as conveyors. The processing plant may be fixed or mobile. In particular mobile processing plants are used in urban surroundings in processing recyclable material such as construction waste.

Ideally the capacity of a processing plant is utilized fully so that the processing plant is kept running continuously with as little interruptions as possible independent on the conditions in accordance with statutes regulating the running of processing plants for example in urban environments e.g. due to noise and dust production.

Dust production of the processing plant is often reduced with water spraying. In cold conditions the dust prevention with water spraying requires heating arrangements and/or use of antifreeze liquids. The antifreeze liquid consumption can be relatively high, causing costs and extra service need, and the liquids themselves may be less environmental friendly. Accordingly, it is desirable to minimize the consumption of antifreeze or similar additives.

An objective of the invention is to provide a mineral material processing plant that may be used in a cost effective and environmental friendly manner in all conditions.

SUMMARY

According to a first aspect of the invention there is provided a method for recovering antifreeze from a dust prevention system of a mineral material processing plant, comprising sucking water using a pump from a water inlet via a first valve displacing the antifreeze via a nozzle manifold into an antifreeze tank until the water reaches a second valve; and connecting the second valve to a third valve to allow circulation of water in the system.

The method may further comprise connecting a water inlet via the first valve to the pump and closing a connection from the antifreeze tank to the first valve prior to sucking water.

The water reaching the second valve may be detected by measuring time and/or measuring with a chemical, optical or temperature sensor.

The method may further comprise sucking antifreeze using the pump from an antifreeze inlet via the first valve and the second valve into the antifreeze tank in order to replenish the supply of the antifreeze in the antifreeze tank.

According to a second aspect of the invention there is provided a system for recovering antifreeze from a dust prevention system of a mineral material processing plant, comprising an antifreeze tank;

a pump configured to circulate water and/or antifreeze;

a first valve configured to connect to a water inlet and/or antifreeze tank to the pump;

a nozzle manifold connected to the pump;

a second valve configured to connect the nozzle manifold to the antifreeze tank and/or a third valve; and a control system configured to operate the system according to a method of the first aspect of the invention.

The system may further comprise a flow constrictor between the third valve and the pump.

The system may further comprise an arrangement for heating the nozzles of the nozzle manifold.

The system may further comprise a drain outlet.

The system may further comprise an antifreeze inlet.

The system may further comprise a second pump.

The system may further comprise at least one stop cock between the antifreeze tank and/or the antifreeze inlet and the first valve.

The system may further comprise an arrangement for heating the antifreeze in the antifreeze tank.

According to a third aspect of the invention there is provided a mineral material processing plant comprising the system of the second aspect of the invention.

According to a fourth aspect of the invention there is provided a control system for controlling a dust prevention system configured to control the system according to a method of the first aspect of the invention.

According to a fifth aspect of the invention there is provided a computer program comprising computer executable program code that when executed causes a computer to execute a method according to the first aspect of the invention.

Different embodiments of the present invention will be illustrated or have been illustrated only in connection with some aspects of the invention. A skilled person appreciates that any embodiment of an aspect of the invention may apply to the same aspect of the invention and other aspects

BRIEF DESCRIPTION OF THE DRAWINGS

The invention will now be described, by way of example, with reference to the accompanying drawings, in which.

DETAILED DESCRIPTION

In the following description, like numbers denote like elements. It should be appreciated that the illustrated figures are not entirely in scale, and that the figures mainly serve the purpose of illustrating embodiments of the invention.

Figure 1:
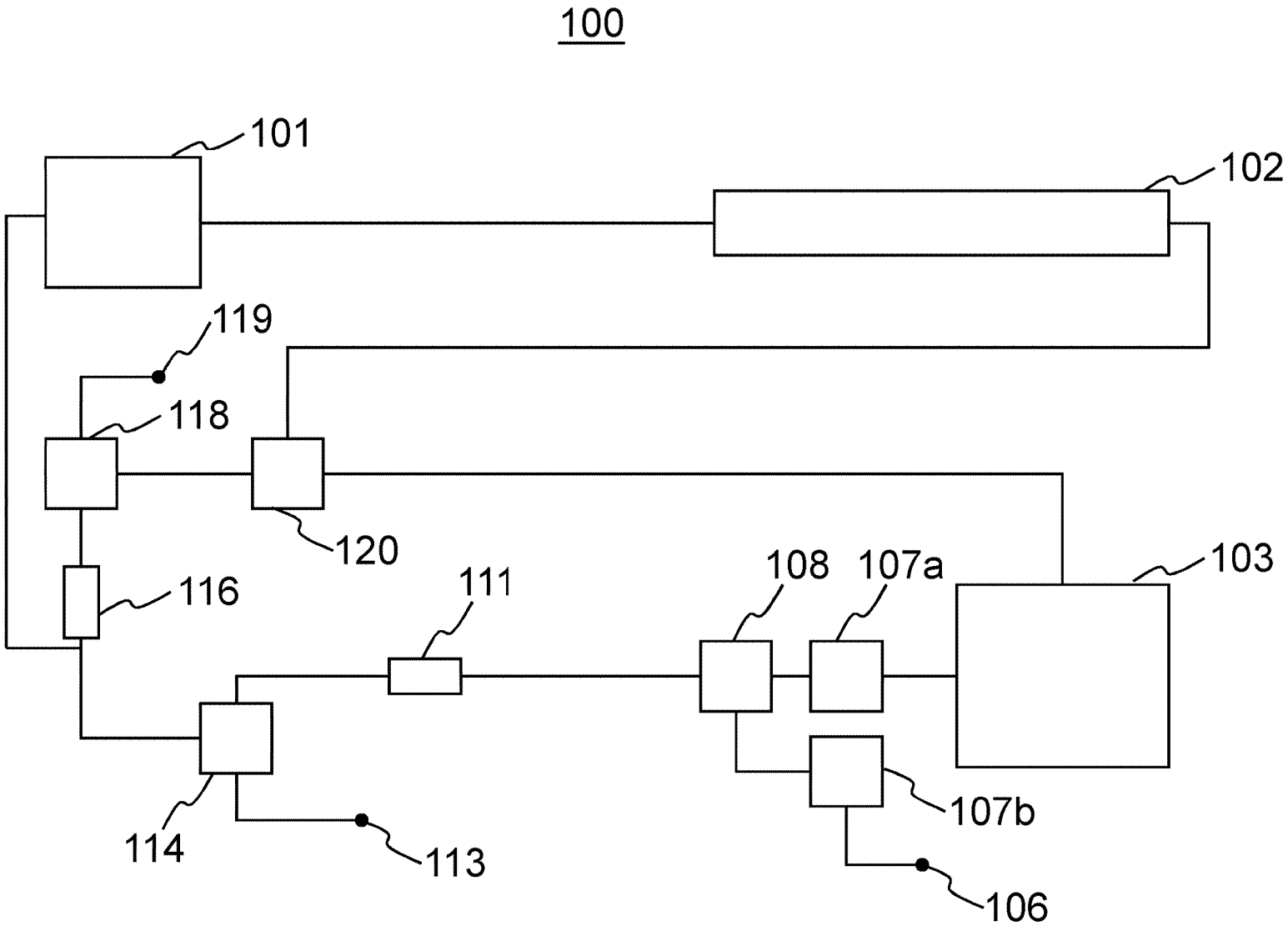
FIG. 1 shows a system according to an embodiment of the invention.

FIG. 1 shows a system according to an embodiment of the invention. The dust prevention system 100 according to an embodiment of the invention comprises a pump 101, for example a high pressure pump, and connected thereto a manifold 102 of heated high pressure nozzles for spraying water. The details of the nozzles are not shown, but the number of the nozzles is for example 6 and the nozzles are heated electrically in a conventional matter. The high pressure dust prevention system 100 according to an embodiment of the invention further comprises an antifreeze tank 103 for holding a suitable antifreeze liquid, such as wind screen washer fluid, and a water inlet 113. The water inlet is connected to the high pressure pump via a first valve 114 and suitable piping. The details of the piping, i.e. pipes or tubes are not shown in the schematic representation of FIG. 1.

In an embodiment, the antifreeze tank 103 is connected to the first valve 114 via a first stop cock 107*a*, connector 108, and in a further embodiment via antifreeze pump 111 of a conventional type. The high pressure dust prevention system 100 according to an embodiment of the invention further comprises an antifreeze inlet 106 connected to the connector 108 via a second stop cock 107*b*. A skilled person appreciates that the first and second stop cock 107*a*,107*b* are of a conventional type and are either manual or automatically operated.

In an embodiment, the manifold 102 is connected to the antifreeze tank 103 via a second valve 120 and to the first valve 114 via the second valve 120 a third valve 118 and a flow restrictor 116. The third valve 118 is further connected to a drain outlet 119.

A skilled person appreciates that in a further embodiment, the dust prevention system with antifreeze recovery comprises elements not shown in FIG. 1 and/or some elements shown in FIG. 1 are omitted and/or replaced with elements providing an analogue and/or equivalent functionality. Furthermore, a skilled person appreciates that the dust prevention system is integrated into a mineral material processing plant and operatively connected therewith, i.e. the dust prevention system comprises for example a control system connected to or integrated with the control system of the mineral material processing plant.

Figure 2:
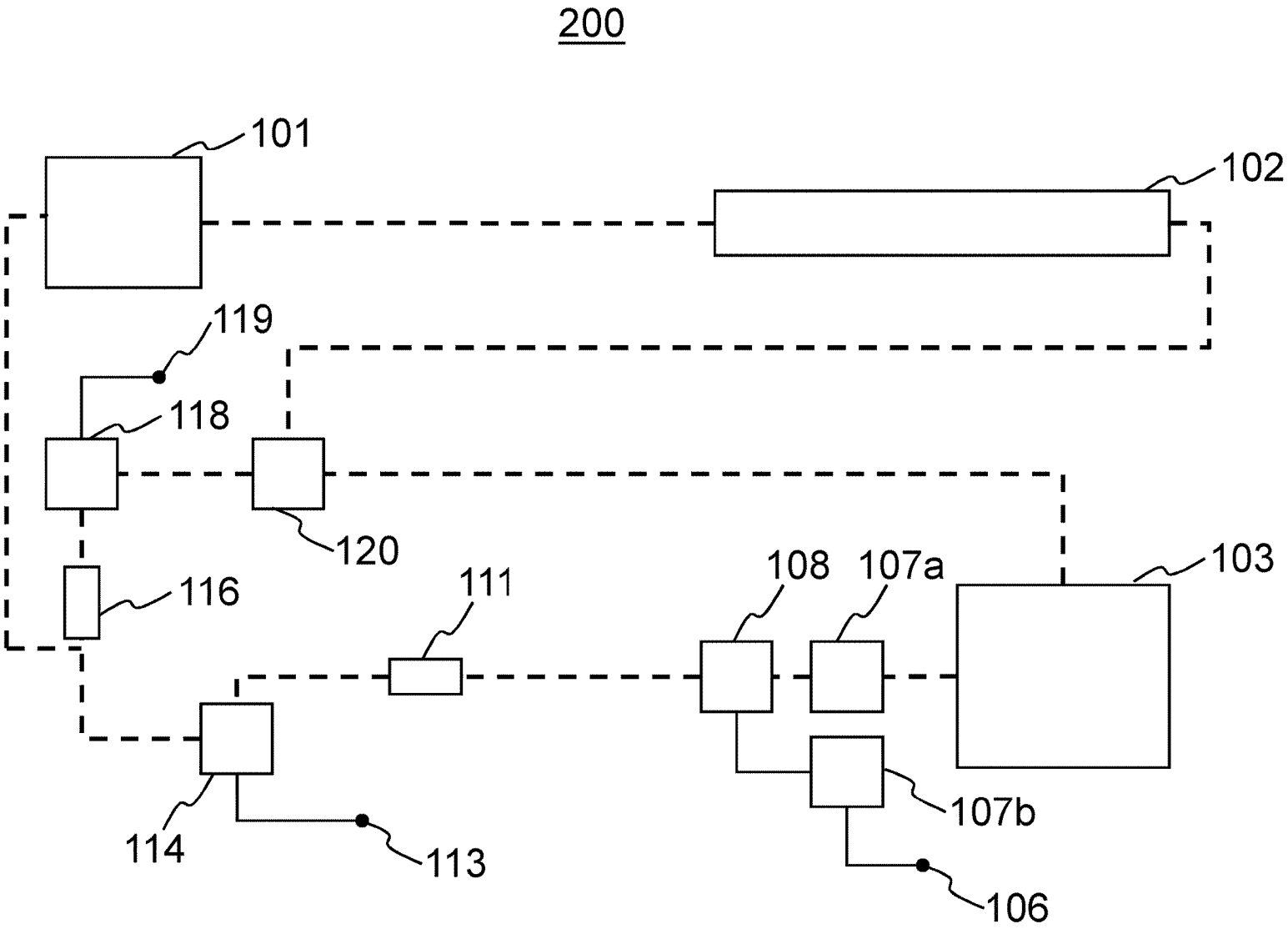
FIG. 2 shows a system according to an embodiment of the invention at a stand-by state according to a method of an embodiment of the invention.

FIG. 2 shows a system according to an embodiment of the invention at a stand-by state 200 according to a method of an embodiment of the invention. At a stand-by state the piping and the elements of the dust prevention system are filled with antifreeze liquid as shown with dashed line in FIG. 2. The stand-by state is used during stand-by of the mineral material processing plant, i.e. when the mineral material processing plant is not operating. The antifreeze liquid protects the dust prevention system from freezing in cold conditions.

Figure 3:
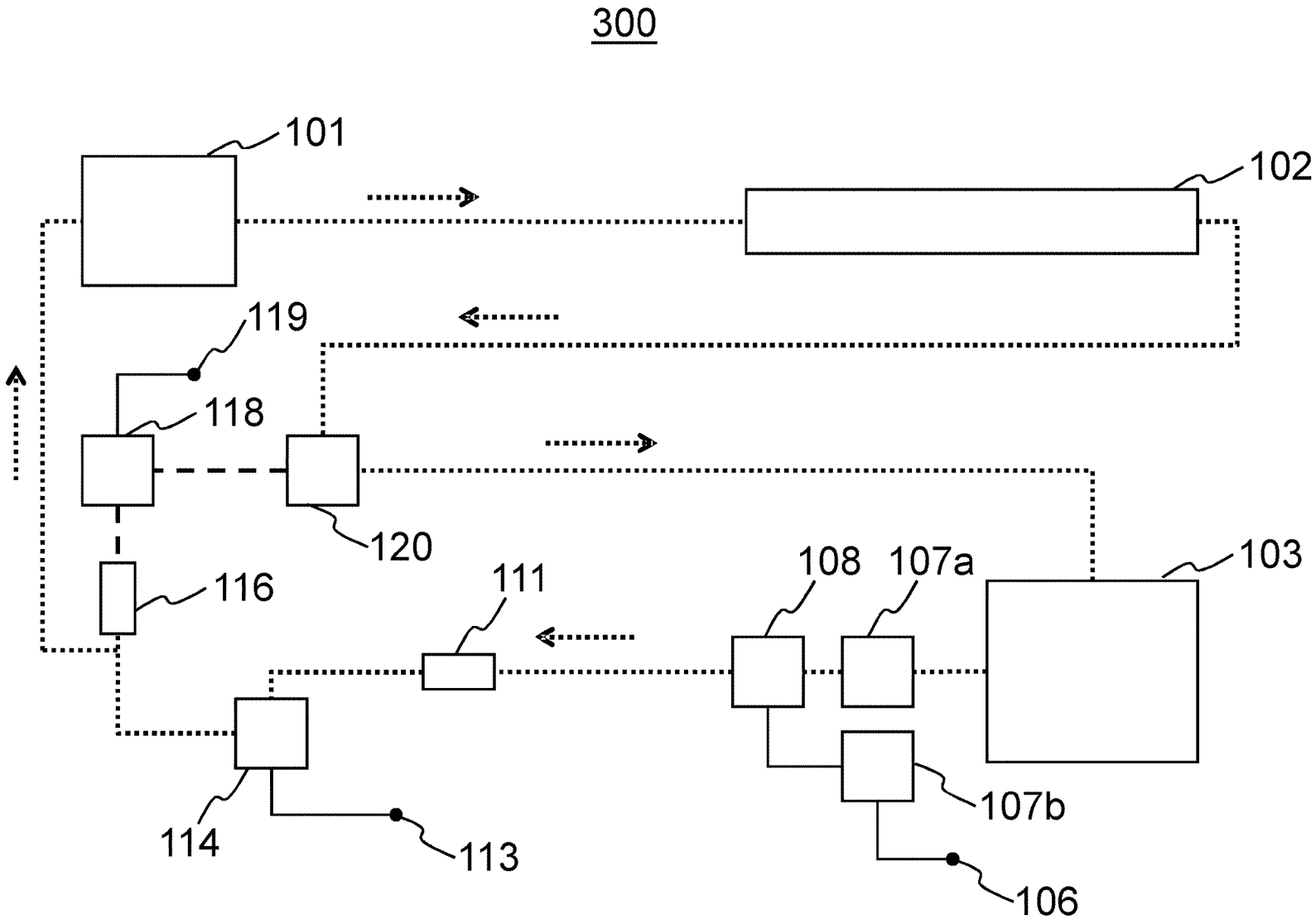
FIG. 3 shows a system according to an embodiment of the invention at a heating phase according to a method of an embodiment of the invention.

FIG. 3 shows a system according to an embodiment of the invention at a heating phase 300 according to a method of an embodiment of the invention. The heating phase is employed prior to starting the dust prevention, i.e. prior to starting the process operation of the mineral material processing plant. The spraying nozzles of the manifold 102 are heated and the antifreeze liquid is circulated in the piping using the either the high pressure pump 101 at a low power setting or the antifreeze pump 111. The circulation of the antifreeze liquid is shown with arrows and a dotted line in FIG. 3 and the valves on the circulation route are set in such a position as to allow the circulation. The antifreeze tank 103 is thermally insulated and in an embodiment heated for example using engine coolant and/or a further heating arrangement such as electrical heating.

Figure 4:
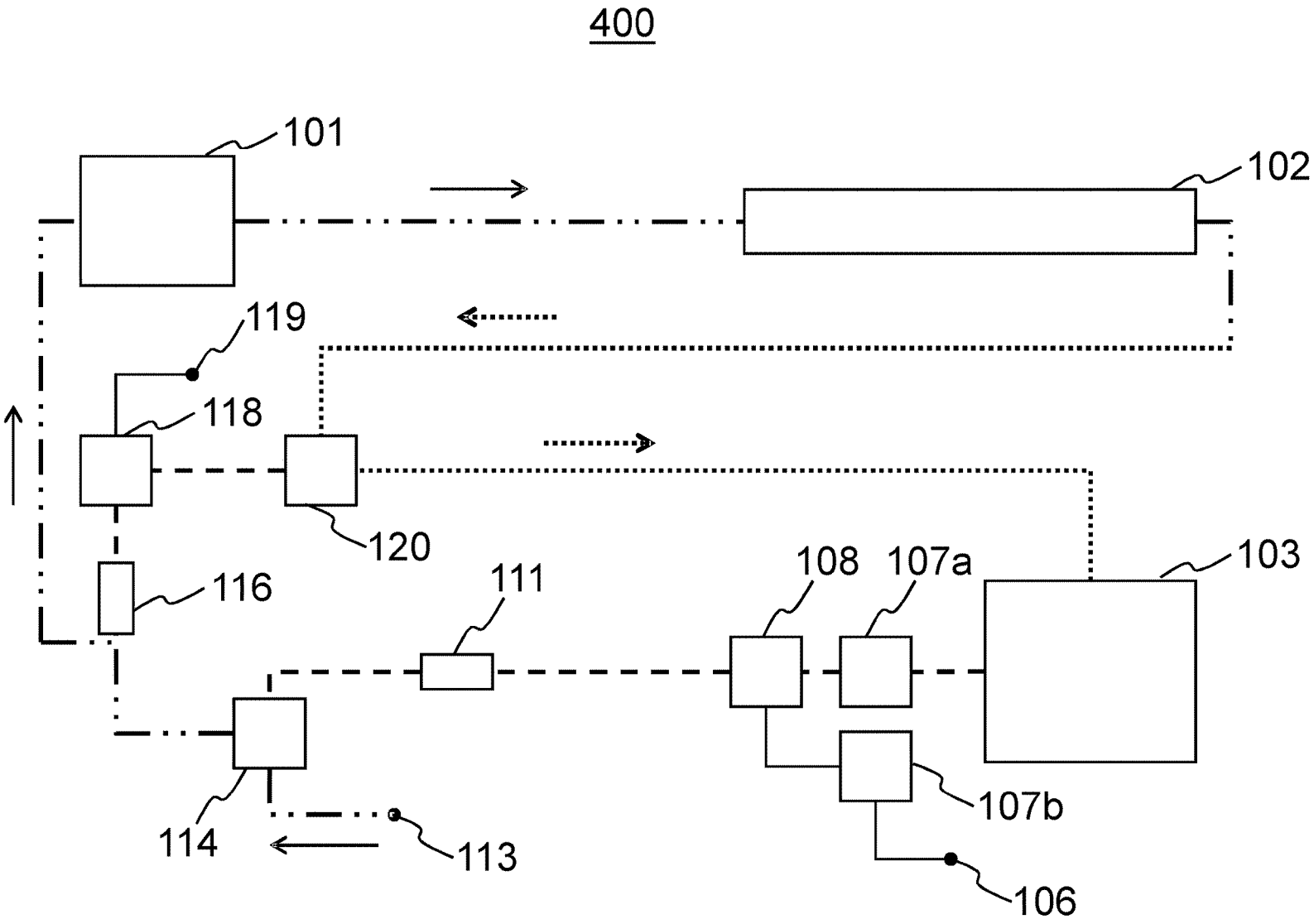
FIG. 4 shows a system according to an embodiment of the invention at an antifreeze recovery phase according to a method of an embodiment of the invention.

Prior to starting spraying water from the manifold 102 the antifreeze liquid is according to an embodiment of the invention recovered from the dust prevention system and replaced with water. FIG. 4 shows a system according to an embodiment of the invention at an antifreeze recovery phase 400 according to a method of an embodiment of the invention. The first valve 114 is connected to the water inlet 113 and to the high pressure pump 101 in order to allow water to fill the piping. The water flowing into the piping, shown with a dashed and double dotted line in FIG. 4, displaces the antifreeze liquid into the antifreeze tank 103 via the second valve 120. The high pressure pump 101 is stopped when the water reaches or prior to water reaching the second valve 120 in order to prevent water from entering the antifreeze liquid tank, and subsequently the second valve 120 is adjusted so that water will flow in the direction of the third valve 118. The moment when the pump 101 is stopped is chosen based on for example the time elapsed and/or detection with a sensor such as an optical, chemical or temperature sensor. A small amount of antifreeze liquid remains in the piping not used for water circulation during water spraying action as shown with a dashed line in FIG. 4 and in FIG. 5. Furthermore, a small amount of antifreeze liquid is not recovered, for example from the piping between the second valve 120 and the third valve 118. During antifreeze recovery phase, the nozzles of the manifold 102 are again heated electrically.

Figure 5:
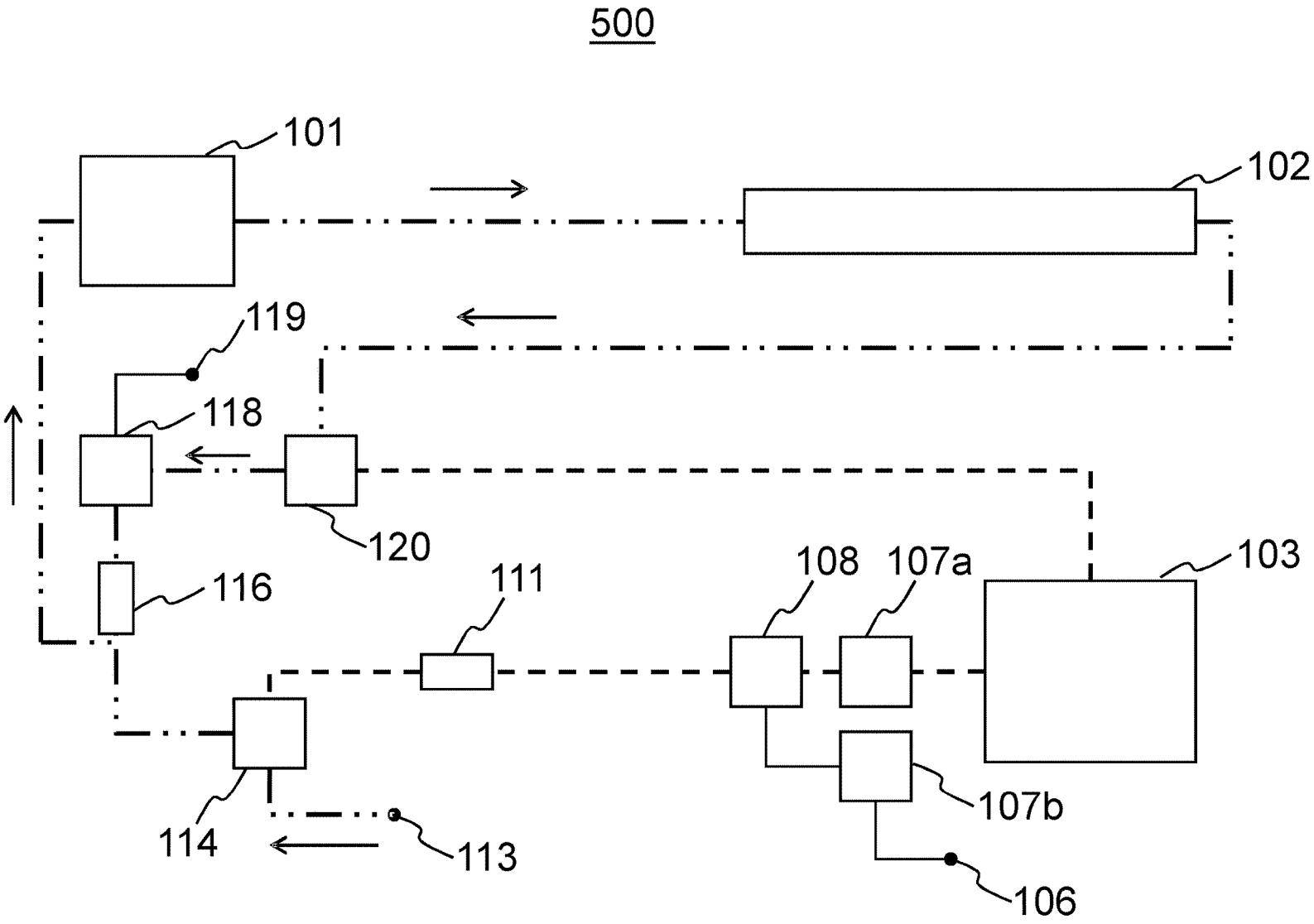
FIG. 5 shows a system according to an embodiment of the invention at a spraying phase according to a method of an embodiment of the invention.

FIG. 5 shows a system according to an embodiment of the invention at a spraying phase 500 according to a method of an embodiment of the invention, i.e. in a phase wherein the mineral material processing plant is in process operation. The nozzles of the manifold 102 are again heated electrically to avoid freezing. The water is circulated using the high pressure pump 101 via the manifold 102, the second valve 120, the third valve 118 and the flow restrictor 118. The sprayed water is replaced with water from the water inlet 113 via the first valve 114. The circulation of water is shown with a dashed and double dotted line and arrows in FIG. 5.

Figure 6:
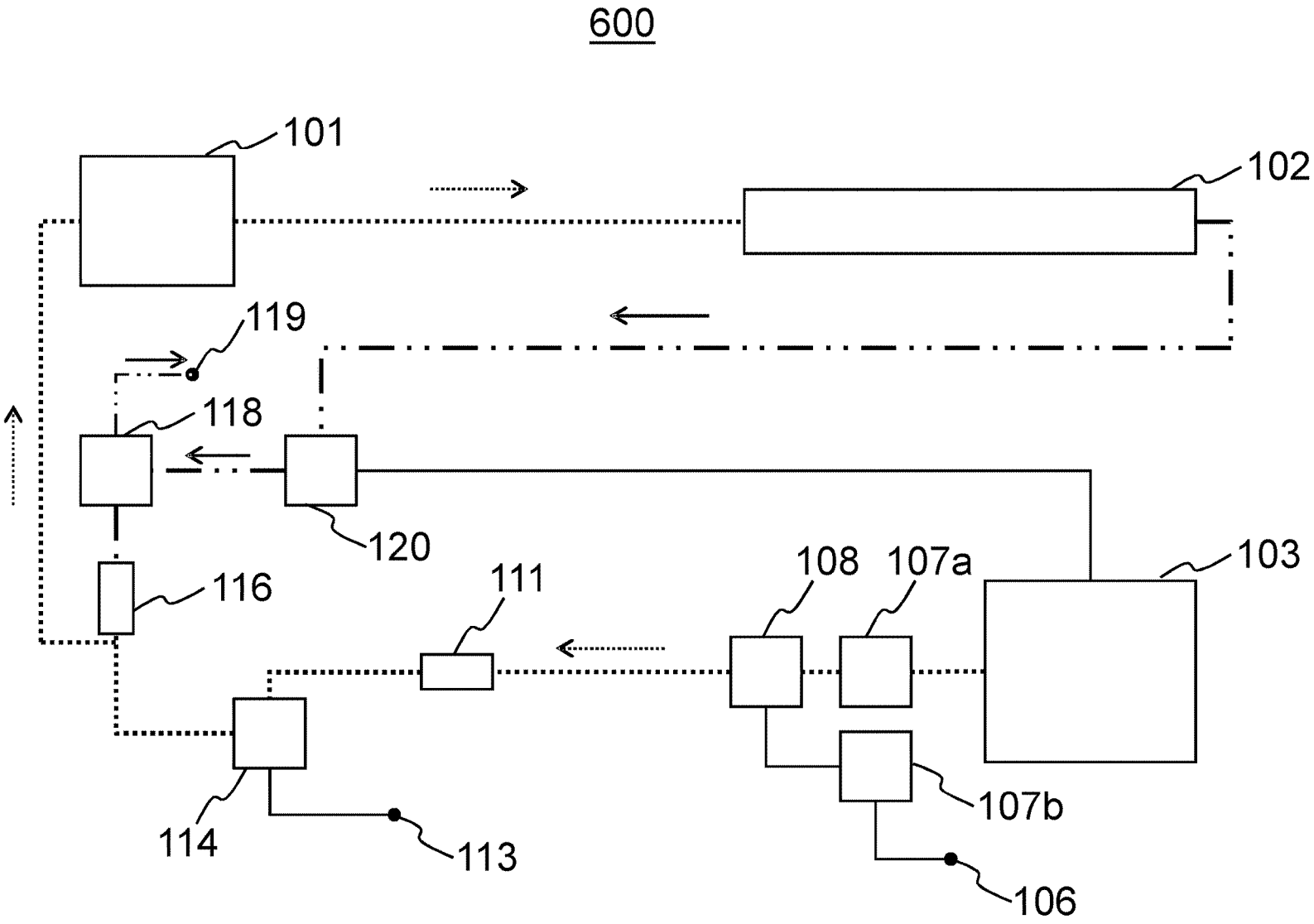
FIG. 6 shows a system according to an embodiment of the invention at a water draining phase according to a method of an embodiment of the invention.

After the spraying action is stopped, i.e. the mineral material processing plant ceases process operations, the water needs to be removed from the dust prevention system in order to avoid freezing thereof. FIG. 6 shows a system according to an embodiment of the invention at a water draining phase 600 according to a method of an embodiment of the invention. The third valve 118 is connected to the drain outlet 119. The antifreeze tank is connected via the stop cock 107*a*, the connector 108 and the first valve 114 to the high pressure pump and the antifreeze liquid is pumped to the system and displaces the water out of the piping via the drain outlet 119 as shown with arrows in FIG. 6. The nozzles of the manifold 102 are again heated electrically to avoid freezing.

Figure 7:
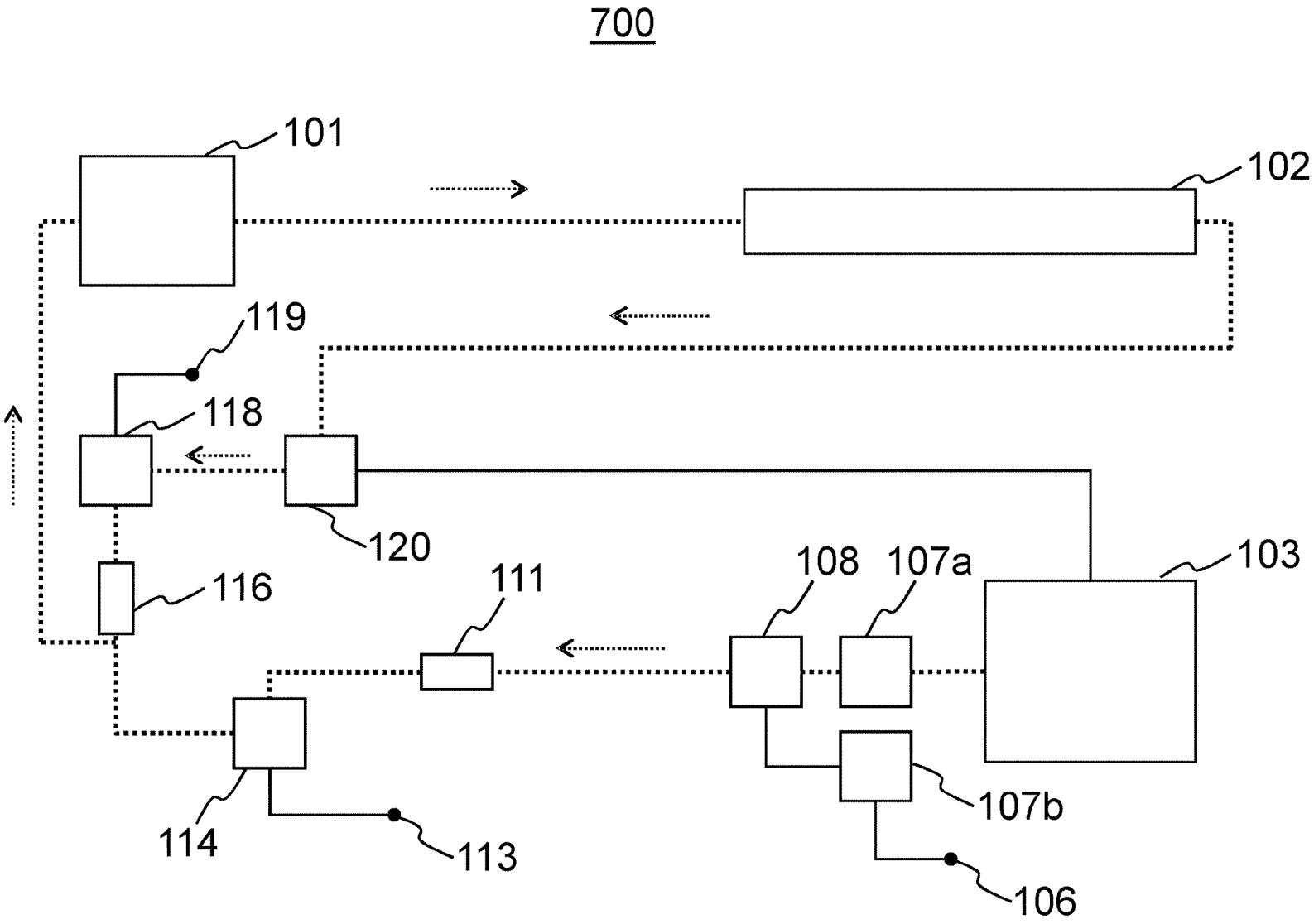
FIG. 7 shows a system according to an embodiment of the invention at an antifreeze fill-in phase according to a method of an embodiment of the invention.

After the water has been displaced from the system, the antifreeze liquid is circulated to all parts of the system. FIG. 7 shows a system according to an embodiment of the invention at an antifreeze fill-in phase 700 according to a method of an embodiment of the invention. The antifreeze liquid is circulated via the manifold, the second valve 120, the third valve 118 and the flow constrictor 116. Additional antifreeze liquid is still sucked from the antifreeze tank 103 via the valve 114.

Figure 8:
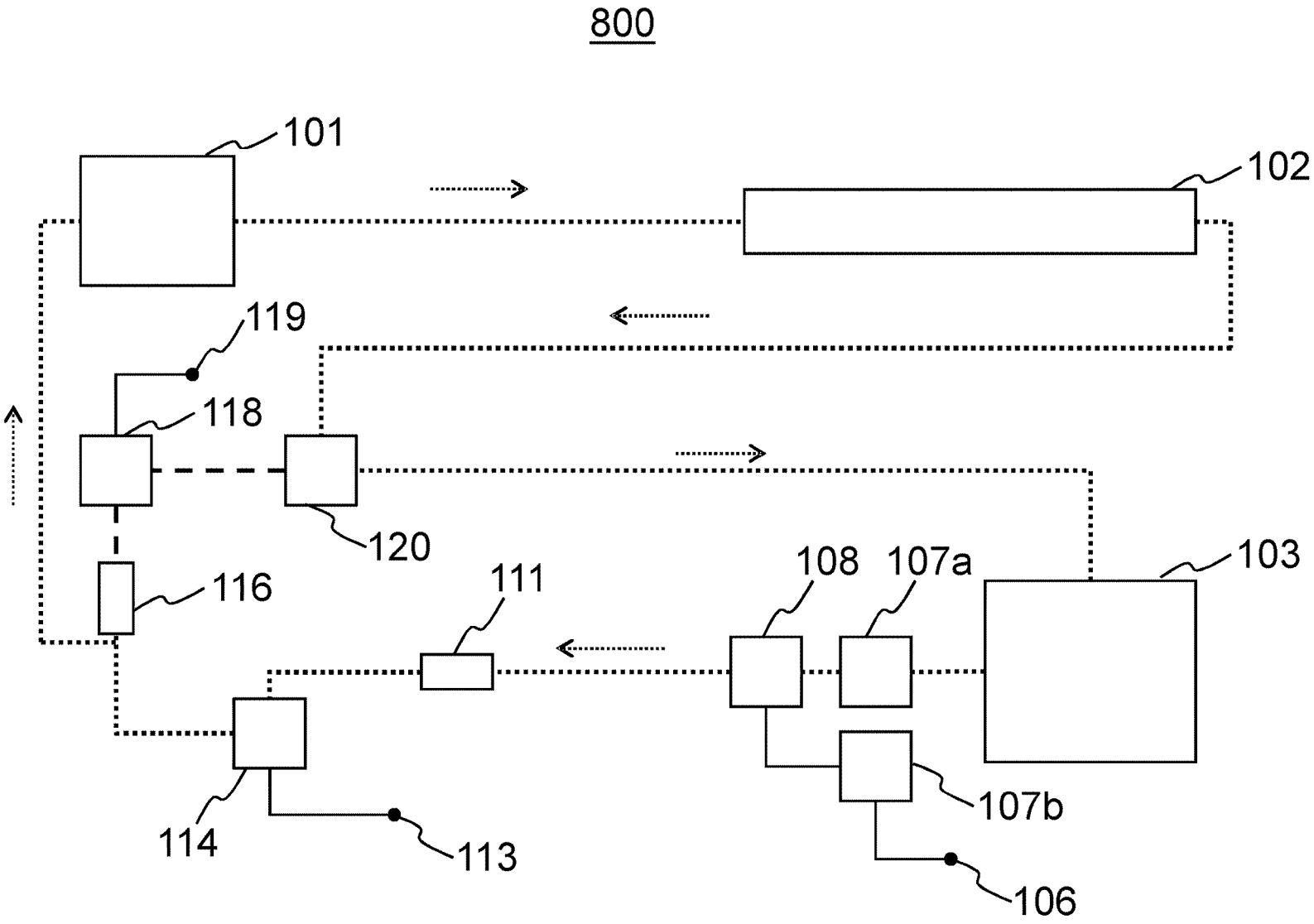
FIG. 8 shows a system according to an embodiment of the invention at an antifreeze fill-in circulation phase according to a method of an embodiment of the invention.

After the piping between the second valve 120, the third valve 118 and the fluid constrictor is filled with antifreeze liquid, the second valve is adjusted so as to direct the circulation via the antifreeze tank 103. FIG. 8 shows a system according to an embodiment of the invention at an antifreeze fill-in circulation phase 800 according to a method of an embodiment of the invention. The circulation of the antifreeze liquid is shown with a dotted line and arrows and the rest of the piping is filled with antifreeze as shown with a dashed line. The circulation of the antifreeze liquid is effected with the high pressure pump 102 at a low setting and/or in an embodiment with the antifreeze pump 111. After the phase 800, the circulation of the antifreeze fluid is stopped and the system returns to the stand-by state shown in FIG. 1.

Figure 9:
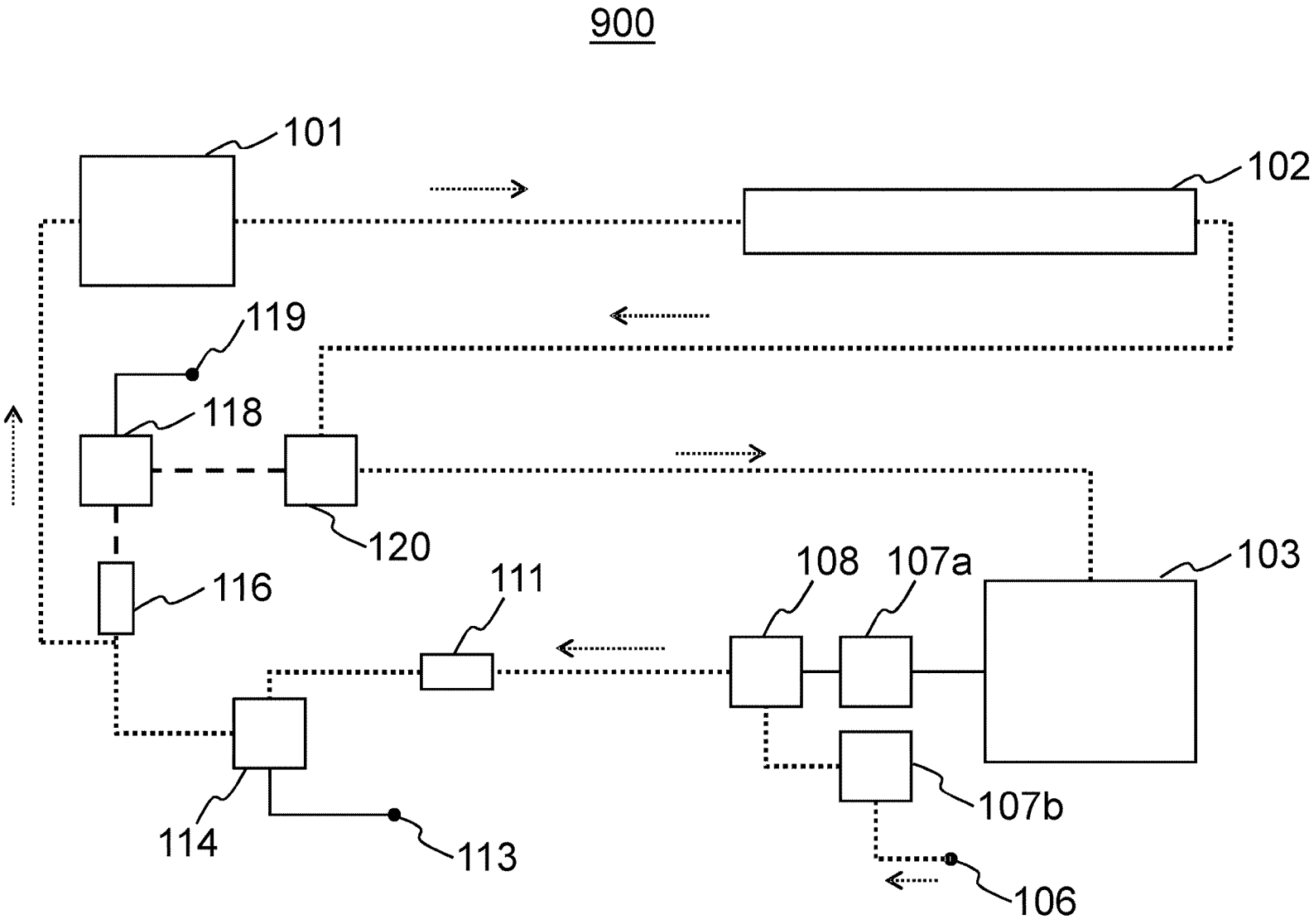
FIG. 9 shows a system according to an embodiment of the invention at an antifreeze container fill-in phase according to a method of an embodiment of the invention.

FIG. 9 shows a system according to an embodiment of the invention at an antifreeze container fill-in phase according to a method of an embodiment of the invention. Although the antifreeze liquid is recovered from the system, a small amount of the antifreeze liquid is anyhow lost. In order to replenish the supply of the antifreeze liquid, the antifreeze inlet 106 is connected via the stop cock 107*b* and the connector 108 and antifreeze liquid is sucked from the inlet using the high pressure pump 101 at a low setting and/or in an embodiment the antifreeze pump 111 and circulated via the first valve 114, the high pressure pump 101, the manifold 102 and the second valve 120 into the antifreeze tank 103.

Figure 10:
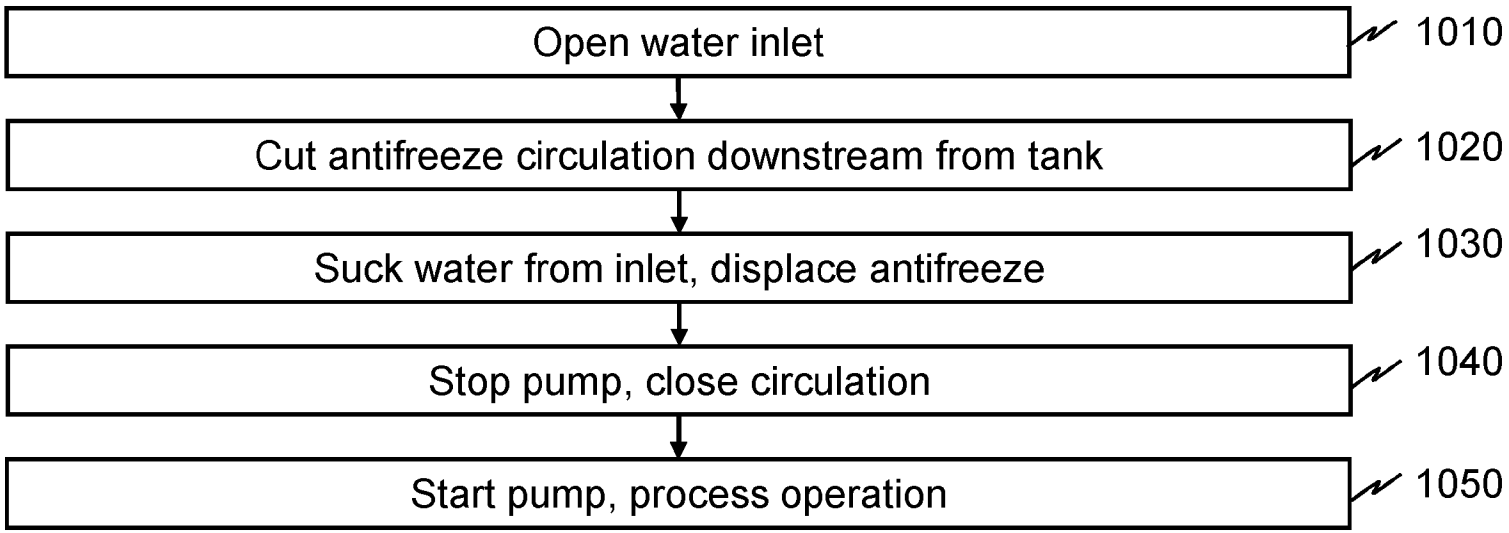
FIG. 10 shows a flow chart of the antifreeze recovery phase according to a method of an embodiment of the invention.

FIG. 10 shows a flow chart of the antifreeze recovery phase according to a method of an embodiment of the invention. The flow chart corresponds to the antifreeze recovery phase explained hereinbefore with respect to FIG. 4. At phase 1010 the water inlet 113 is connected to the circulation via the first valve 114. At step 1020 the antifreeze circulation is stopped by with the valve 114 so that the antifreeze liquid will only flow to the antifreeze tank 103. At step 1030 water is sucked from the water inlet 113 using the high pressure pump 101. As the water enters the circulation, the antifreeze liquid is displaced before it and ends up in the antifreeze tank 103. When the water reaches or prior to water reaching the second valve 120 and therethrough ending up in the antifreeze tank 103, the pump 101 is stopped at step 1040 and the antifreeze circulation is stopped, i.e. the second valve 120 is adjusted so that the water will flow towards the third valve 118 thus allowing the water circulation for spraying. The moment when the pump 101 is stopped at step 1040 is chosen based on for example the time elapsed and/or detection with a sensor such as an optical, chemical or temperature sensor. At step 1050 the pump 101 is started and process operation, i.e. water spraying of the dust prevention system commences.

Without in any way limiting the scope of protection, interpretation or possible applications of the invention, a technical advantage of different embodiments of the invention may be considered to be a reduced use of antifreeze liquid in the mineral material processing plant. Further, a technical advantage of different embodiments of the invention may be considered to be a reduced need for service operations. Further, a technical advantage of different embodiments of the invention may be considered to be an increase of environmental friendliness of a mineral material processing plant. Further, a technical advantage of different embodiments of the invention may be considered to be increasing the number of effective usage hours of a mineral material processing plant.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A system comprising:

a mineral material processing plant operable to process a supply of mineral material;

a dust prevention system including a nozzle manifold including a plurality of nozzles to direct a fluid spray onto the supply of mineral material;

an antifreeze tank configured to hold a supply of antifreeze;

a pump configured to selectively circulate water from a water inlet and the supply of antifreeze from the antifreeze tank;

a first valve configured to selectively connect a flow of water from the water inlet or a flow of antifreeze from the antifreeze tank to the pump;

a second valve configured to selectively connect the flow of water or the flow of antifreeze from the nozzle manifold to either the antifreeze tank or a third valve, wherein the third valve is configured to selectively connect the flow of water of the flow of antifreeze from the second valve to the pump; and a control system configured to operate the system to suck water from the water inlet using the pump via the first valve to create the flow of water thereby displacing the antifreeze from the nozzle manifold into the antifreeze tank until the flow of water reaches the second valve and to operate the second valve to connect the flow of water to the third valve to allow circulation of water in the system.

2. The system of claim 1, further comprising a flow constrictor between the third valve and the pump.

3. The system of claim 1, further comprising an arrangement for heating the nozzles of the nozzle manifold.

4. The system of claim 1, further comprising a drain outlet.

5. The system of claim 1, further comprising an antifreeze inlet.

6. The system of claim 1, further comprising a second pump.

7. The system of claim 1, further comprising at least one stop cock between the antifreeze tank and/or an antifreeze inlet and the first valve.

8. The system of claim 1, further comprising an arrangement for heating the antifreeze in the antifreeze tank.

* * * * *